US007617877B2

(12) United States Patent
Hall et al.

(10) Patent No.: US 7,617,877 B2
(45) Date of Patent: Nov. 17, 2009

(54) METHOD OF MANUFACTURING DOWNHOLE TOOL STRING COMPONENTS

(76) Inventors: David R. Hall, 2185 S. Larsen Pkwy., Provo, UT (US) 84606; Scott Dahlgren, 2185 S. Larsen Pkwy., Provo, UT (US) 84606; Jonathon Marshall, 2185 S. Larsen Pkwy., Provo, UT (US) 84606

( * ) Notice: Subject to any disclaimer, the term of this patent is extended or adjusted under 35 U.S.C. 154(b) by 312 days.

(21) Appl. No.: 11/679,727

(22) Filed: Feb. 27, 2007

(65) Prior Publication Data

US 2008/0202765 A1 Aug. 28, 2008

(51) Int. Cl.
*E21B 17/00* (2006.01)

(52) U.S. Cl. ..... 166/380; 166/242.6; 166/65.1

(58) Field of Classification Search ..... 166/378, 166/380, 65.1, 242.6; 439/191, 192; 29/868, 29/869, 871

See application file for complete search history.

(56) References Cited

U.S. PATENT DOCUMENTS

| | | | |
|---|---|---|---|
| 2,000,716 | A | 5/1935 | Polk |
| 2,301,783 | A | 11/1942 | Lee |
| 2,414,719 | A | 1/1947 | Cloud |
| 3,253,245 | A | 5/1966 | Brandt |
| 3,967,201 | A | 6/1976 | Rorden |
| 4,012,092 | A | 3/1977 | Godbey |
| 4,039,237 | A | 8/1977 | Cullen |
| 4,176,894 | A | 12/1979 | Godbey |
| 4,416,494 | A | 11/1983 | Watkins |
| 4,591,226 | A | 5/1986 | Hargett |
| 4,660,910 | A | 4/1987 | Sharp |
| 4,785,247 | A | 11/1988 | Meador |
| 4,806,928 | A | 2/1989 | Vereruso |
| 6,367,564 | B1 | 4/2002 | Mills |
| 6,392,317 | B1 | 5/2002 | Hall |
| 6,402,524 | B2 | 6/2002 | Wurm |
| 6,651,755 | B1 | 11/2003 | Kelpe |
| 6,670,880 | B1 | 12/2003 | Hall |
| 6,717,501 | B2 | 4/2004 | Hall |
| 6,799,632 | B2 | 10/2004 | Hall |
| 6,821,147 | B1 | 11/2004 | Hall |

(Continued)

OTHER PUBLICATIONS

U.S. Appl. No. 11/133,905, filed Nov. 15, 1988, Hall, David R.

*Primary Examiner*—Jennifer H Gay
*Assistant Examiner*—David Andrews
(74) *Attorney, Agent, or Firm*—Tyson J. Wilde; Benjamin T. Miskin

(57) ABSTRACT

A method for making a downhole electrical transmission system, having the steps of providing an electrically conductive assembly disposed within a first downhole tool string component, the assembly having a first end and being anchored to the first tool string component at a first predetermined distance from a primary shoulder of the first end of the component; stretching the assembly by pulling on a second end of the assembly with a stretching tool such that the second end of the assembly is held; enlarging the diameter of the second end of the assembly to a diameter larger than an original diameter of the assembly by flaring the second end of the assembly with a flaring tool; and anchoring the second end of the assembly to the first tool string component at a second predetermined distance from a primary shoulder of the second end of the component.

18 Claims, 10 Drawing Sheets

U.S. PATENT DOCUMENTS 6,830,467 B2 12/2004 Hall
6,844,498 B2 1/2005 Hall
6,888,473 B1 5/2005 Hall
6,913,093 B2 7/2005 Hall
6,929,493 B2 8/2005 Hall
6,945,802 B2 9/2005 Hall
6,968,611 B2 11/2005 Hall
7,404,725 B2 * 7/2008 Hall et al. ..... 439/194
7,488,194 B2 * 2/2009 Hall et al. ..... 439/191
2004/0104797 A1 6/2004 Hall
2004/0113808 A1 6/2004 Hall
2004/0145492 A1 7/2004 Hall
2004/0150532 A1 8/2004 Hall
2004/0164833 A1 8/2004 Hall
2004/0164838 A1 8/2004 Hall
2004/0216847 A1 11/2004 Hall
2004/0244916 A1 12/2004 Hall
2004/0244964 A1 12/2004 Hall
2004/0246142 A1 12/2004 Hall
2005/0001735 A1 1/2005 Hall
2005/0001736 A1 1/2005 Hall
2005/0001738 A1 1/2005 Hall
2005/0035874 A1 2/2005 Hall
2005/0035875 A1 2/2005 Hall
2005/0035876 A1 2/2005 Hall
2005/0036507 A1 2/2005 Hall
2005/0039912 A1 2/2005 Hall
2005/0045339 A1 3/2005 Hall
2005/0046586 A1 3/2005 Hall
2005/0046590 A1 3/2005 Hall
2005/0067159 A1 3/2005 Hall
2005/0070144 A1 3/2005 Hall
2005/0082092 A1 4/2005 Hall
2005/0092499 A1 5/2005 Hall
2005/0093296 A1 5/2005 Hall
2005/0095827 A1 5/2005 Hall
2005/0115717 A1 6/2005 Hall
2005/0145406 A1 7/2005 Hall
2005/0150653 A1 7/2005 Hall
2005/0161215 A1 7/2005 Hall
2005/0173128 A1 8/2005 Hall
2005/0212530 A1 9/2005 Hall
2005/0236160 A1 10/2005 Hall
2005/0284662 A1 12/2005 Hall
2008/0041575 A1 * 2/2008 Clark et al. ..... 166/65.1

* cited by examiner

METHOD OF MANUFACTURING DOWNHOLE TOOL STRING COMPONENTS

BACKGROUND OF THE INVENTION

The present invention relates to the field of data and/or power transmission. More specifically, it relates to the field of apparatus for transmitting data and/or power through such downhole tool strings.

Downhole tool strings have become increasingly versatile in the last half century. In addition to traditional oil, gas, and geothermic exploration and production purposes, tubular tool strings are often used for what is known as horizontal directional drilling to install underground power lines, communication lines, water lines, sewer lines, and gas lines. This sort of downhole drilling is particularly useful for boring underneath roadways, waterways, populated areas, and environmentally protected areas.

The increased versatility of downhole drilling with tool strings has led to a higher demand for apparatus that are able to transmit a power signal to downhole equipment as well as transmit data between downhole and surface tools. Hence, several different approaches to solving the problem of transmitting an electrical signal across the joints of a tool string have been developed and are known in the art.

U.S. Pat. Nos. 6,670,880; 6,983,485; and 6,939,493 to Hall, all of which are incorporated herein by reference for all that they disclose, teach of a system wherein tubular components are inductively coupled at threaded joints in the tool string. Other downhole telemetry systems are disclosed in U.S. Pat. No. 6,688,396 to Floerke et al and U.S. Pat. No. 6,641,434 to Boyle et al, which are also herein incorporated by reference for all that they contain.

Optimally, a system for transmitting electricity between surface equipment and downhole tools in a tool string should be transparent to the tool string operator or crew, as time delays introduced by a complicated telemetry system may represent a significant amount of money.

BRIEF SUMMARY OF THE INVENTION

A method for making a downhole electrical transmission system, having the steps of providing an electrically conductive assembly disposed within a first downhole tool string component, the assembly having a first end and being anchored to the first tool string component at a first predetermined distance from a primary shoulder of the first end of the component; stretching the assembly by pulling on a second end of the assembly with a stretching tool such that the second end of the assembly is held; enlarging the diameter of the second end of the assembly to a diameter larger than an original diameter of the assembly by flaring the second end of the assembly with a flaring tool; and anchoring the second end of the assembly to the first tool string component at a second predetermined distance from a primary shoulder of the second end of the component.

The conductive assembly may be centered within the tool string component or a portion of the conductive assembly may be disposed along a bore wall of the first tool string component. The conductive assembly may comprise a plurality of flares at the first and second ends. Excess material may be removed from the second end of the conductive assembly. An electrically conductive mating surface disposed within an electrically insulating material may be inserted into the second end of the conductive assembly after flaring the second end of the conductive assembly. The second end of the conductive assembly may comprise a pressure release port. An electrically conductive assembly disposed within a second tool string component may be coupled with the conductive assembly of the first tool string component. The stretching tool may be adapted to interlock with a sleeve disposed around the second end of the conductive assembly.

The conductive assembly may be anchored to a stabilizing element disposed within the first tool string component. The stabilizing element may be brazed to a bore wall of the component. The stabilizing element may be disposed within a recess in a bore wall of the component.

A bracing assembly may be disposed around at least a portion of the second end of the component. The bracing assembly may be adapted to receive the stretching tool. The bracing assembly may be adapted to receive the flaring tool. The bracing assembly may comprise a pneumatic or hydraulic chamber. The bracing assembly may be adapted to anchor the second end of the conductive assembly after stretching the conductive assembly. The stretching tool may be adapted to receive the flaring tool.

The downhole tool string component may be a drill pipe, a drill collar, a horizontal drill pipe, a reamer, a cross over sub, a heavy weight pipe, a production pipe, or combinations thereof.

In another aspect of the present invention, a method for making a downhole electrical transmission system may comprise the steps of providing first and second tool string components of different lengths; providing a first electrically conductive assembly disposed within the first tool string component and comprising a first end anchored to the first component at a first predetermined distance from a primary shoulder of a first end of the first component; providing a second electrically conductive assembly disposed within the second tool string component and comprising a first end anchored to the second component at the first predetermined distance from a primary shoulder of a first end of the second component; stretching the first and second electrically conductive assemblies individually by pulling on a second end of each conductive assembly with a stretching tool to a second predetermined distance from a primary shoulder of second ends of each component; enlarging the diameter of the second end of each conductive assembly to a diameter larger than an original diameter of the electrically conductive assemblies by flaring the second end of each conductive assembly with a flaring tool; and anchoring the second ends of each conductive assembly to their respective tool string components at the second predetermined distance.

DETAILED DESCRIPTION OF THE INVENTION AND THE PREFERRED EMBODIMENT

Figure 1:
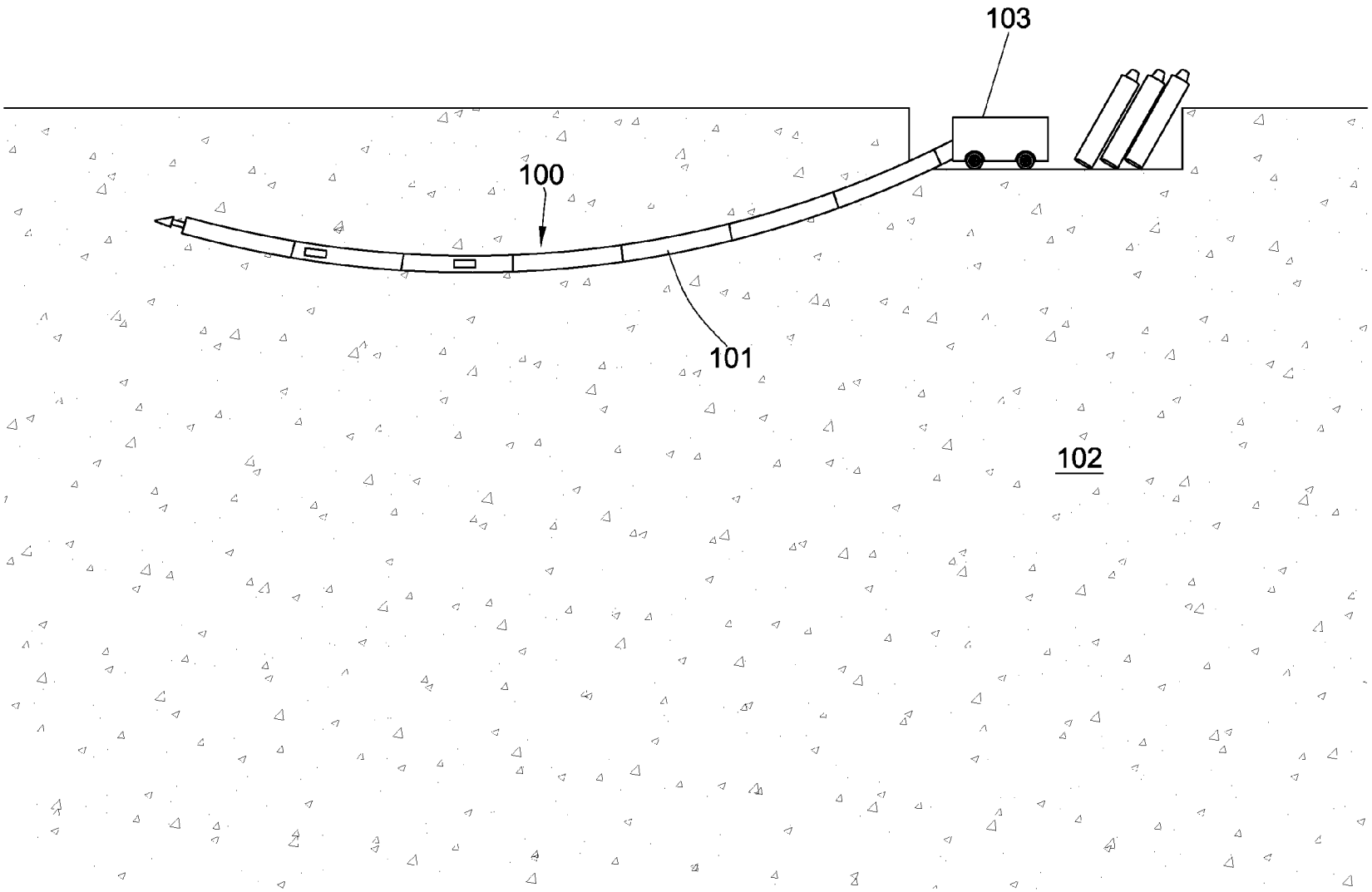
FIG. 1 is a cross-sectional diagram of an embodiment of a drill string in a horizontal drill well.

A drill string 100 may drill a bore hole 101 in subterranean formation 102 in a horizontal direction. In the embodiment of FIG. 1, a rig 103 is placed at the surface and is angled such that the drill string 100 penetrates the surface at a non-perpendicular angle. As the drill string 100 advances, the bore hole 101 gradually becomes generally parallel to the surface and then eventually returns to the surface at a predetermined location, at which time a back reamer may be attached to the drill string 100 and pulled back through the bore hole 101 in order to widen the hole for pipe and other tools to be inserted. Cables such as fiber optic or metal cables may also be attached to the drill string 100 as it is pulled back through the bore hole 101. Such drill strings may be used for oil and gas drilling, coal methane drilling, injection drilling, or combinations thereof.

To accomplish horizontal directional drilling, the drill string 100 may comprise a steering mechanism. The steering mechanism may allow the drill string 100 to change direction while drilling, which may allow the drill string 100 to avoid known obstacles such as bodies of water or paved surfaces. Surface equipment, which may be part of the rig 103, may allow drill string operators to observe and manually control the direction of the bore hole 101.

Figure 2:
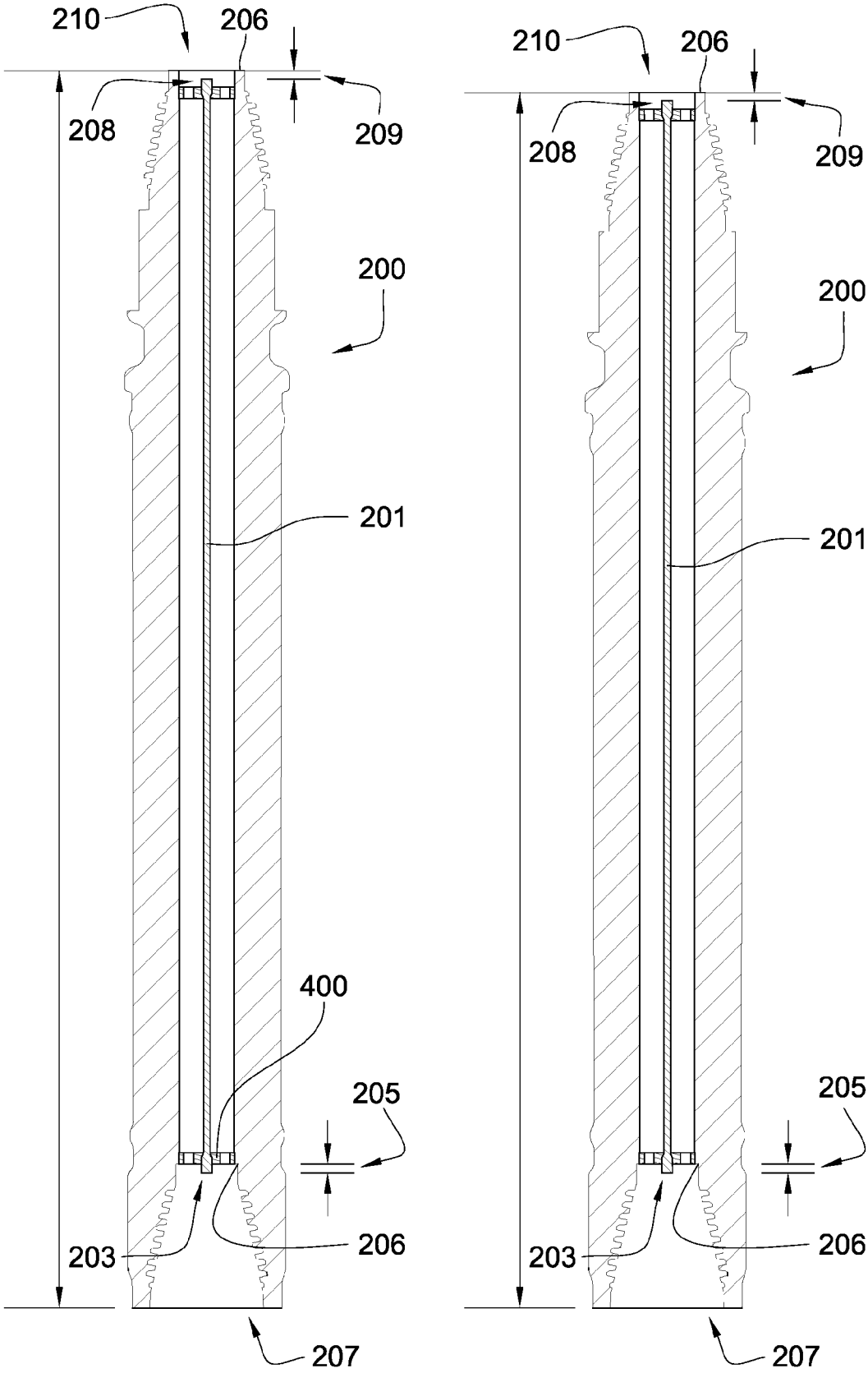
FIG. 2 is a cross-sectional diagram of an embodiment of two tool string components of different lengths.

Downhole tool string components 200 in the drill string may comprise electrically conductive assemblies 201 used in an electrical transmission system, as in the embodiment of FIG. 2. The assemblies 201 may be centered within the tool string components 200, although the assemblies 201 may also be disposed along a bore wall 202 or anywhere within the components 200. Each assembly 201 comprises a first end 203 and a second end 208. The first end 203 of each assembly 201 is anchored at a first predetermined distance 205 from a primary shoulder 206 of a first end 207 of each component 200, the first predetermined distance 205 being the same in each component 200. The second end 208 of each assembly 201 is also anchored to the components 200 at a second predetermined distance 209 from a primary shoulder 206 of a second end 210 of each component 200, the second predetermined distance 209 also being the same in each component 200. Each component 200 may vary, usually slightly, in length due to possible imprecision in manufacturing processes. Because of this, each assembly 201 may be stretched and disposed within the separate components 200 at different lengths and/or tensions.

Figure 3:
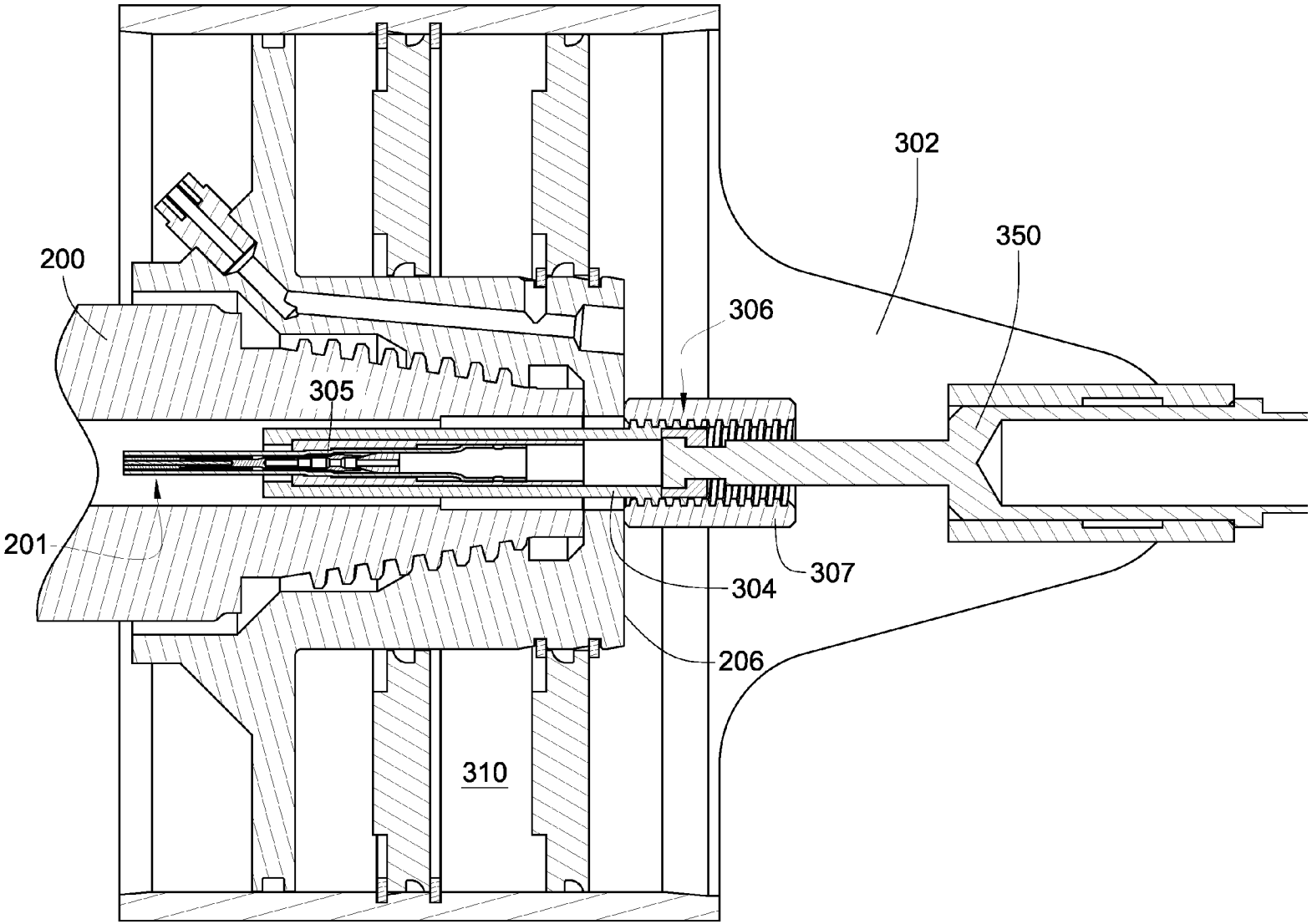
FIG. 3 is a cross-sectional diagram of an embodiment of a stretching apparatus.
Figure 4:
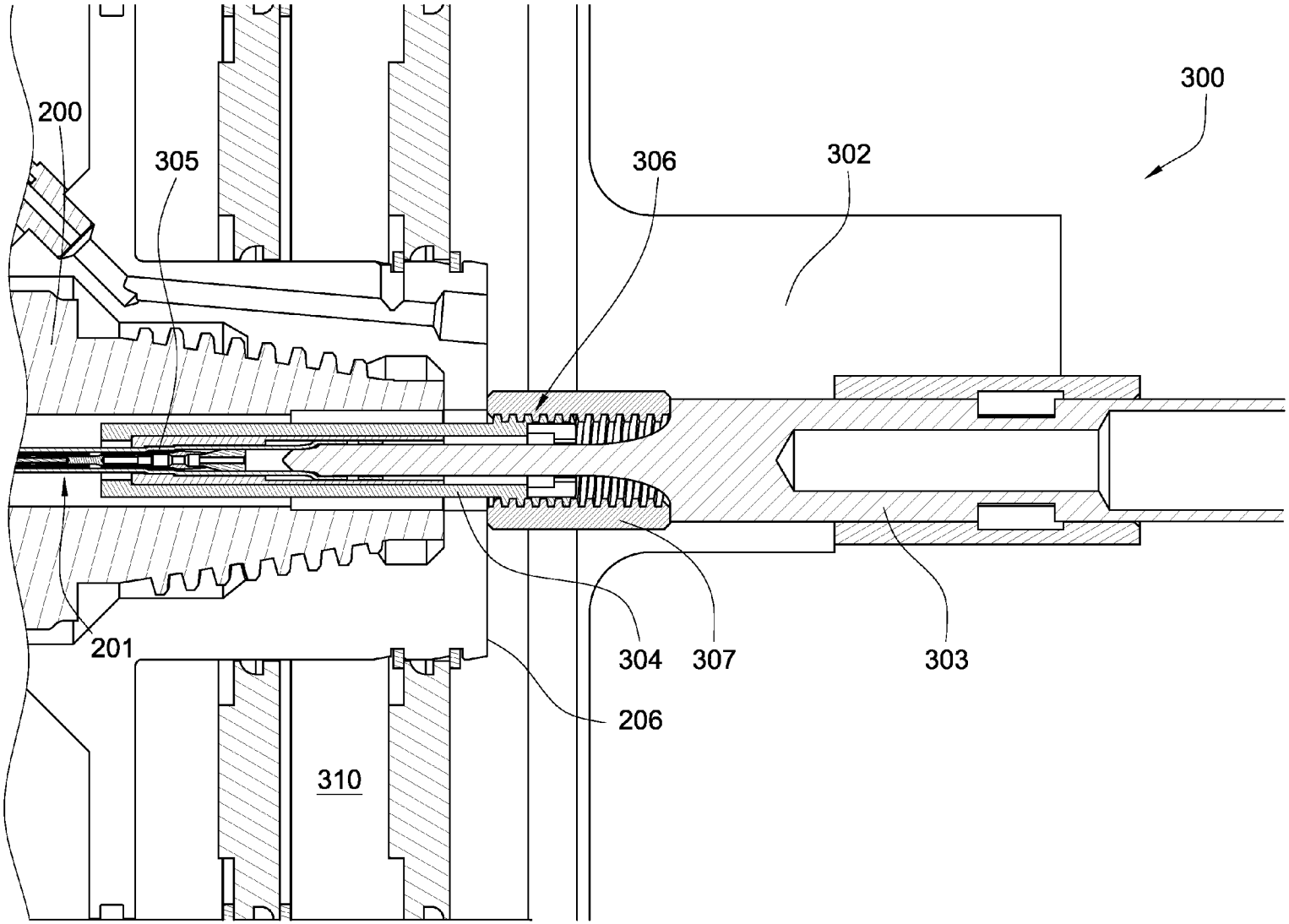
FIG. 4 is a cross-sectional diagram of an embodiment of a flaring apparatus.

When installing the conductive assembly 201 in the component 200, and prior to stretching the conductive assembly 201, the conductive assembly 201 may be anchored in the first end 207 of the component 200 at the first end 203 of the conductive assembly 201 by a stabilizing element 400, the first end 203 being enlarged prior to installation. The present invention discloses a method and apparatus 300 to stretch and enlarging an electrically conductive assembly 201 by flaring the 201 at an end in order to custom fit the assembly 201 to a component 200, one embodiment of the apparatus 300 being shown in FIGS. 3 and 4.

A bracing assembly 302 may be disposed around at least a portion of the second end 210 of the component 200, the pin end in this embodiment. The bracing assembly 302 may be adapted to receive a stretching tool 350 and a flaring tool 303. The stretching tool 350 may interlock with a sleeve 304 (which may be removed after stretching and flaring the assembly 201) disposed around the second end 208 of the assembly 201 such that as the stretching tool is pulled away from the component 200 the assembly 201 stretches. The assembly 201 may comprise a plurality of flares 305 which allow the sleeve 304 to maintain a grip on the assembly 201. When the second end 208 of the assembly 201 is stretched to the second predetermined distance 209 from the primary shoulder 206, the second end 208 of the assembly 201 may be temporarily anchored to the component 200 with a threaded nut 307 so that it may be flared. A portion 306 of the sleeve 304 may be threaded and may extend beyond the primary shoulder 206 to receive the threaded nut 307. The stretching tool may then be removed and the flaring tool 303 may be inserted into the second end 208 of the assembly 201. A shoulder 307 of the flaring tool 303 may abut a portion of the sleeve 304 or nut 307 to control the amount of the assembly 201 that is flared. The bracing assembly 302 may comprise a pneumatic or hydraulic chamber 310, which may aid in stretching or flaring the assembly 201. The flaring tool 303, nut 307, sleeve 304, and bracing assembly 302 may be removed once the assembly 201 is stretched and flared so that the assembly 201 may then be anchored to the tool string component 200 with the stabilizing element 400 at the second predetermined distance 209.

Figure 5:
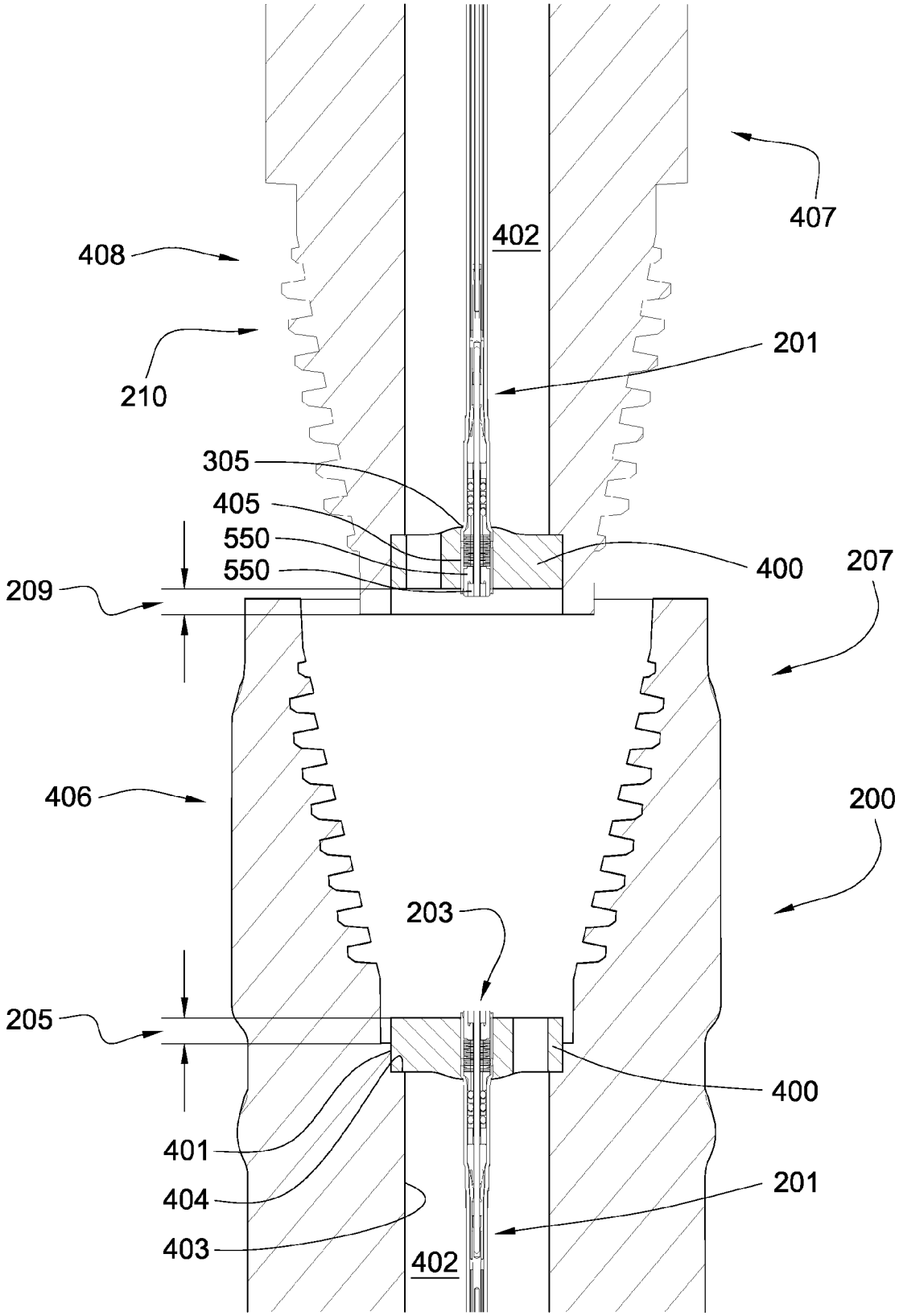
FIG. 5 is a cross-sectional diagram of an embodiment of electrically conductive assemblies disposed within ends of separate tool string components.

The assemblies 201 may be anchored to the tool string components 200 at the first and second ends 207, 210 of the component by stabilizing elements 400 disposed within bores 402 of the components, as in the embodiment of FIG. 5. The stabilizing element 400 may be disposed within a recess 401 in the bore wall 403. The stabilizing element 400 may abut a lip 404 in the bore wall 403 such that when the assembly 201 is in tension, the stabilizing element 400 is held against the lip. The stabilizing element 400 may comprise a central opening 405 wherein the assembly 201 may be disposed, though the assembly 201 may be disposed within any portion of the stabilizing element 400. The opening 405 may comprise a varying diameter in order to grip the assembly 201 at the flare 305 and keep the assembly 201 in tension between flares 305 at both ends 203, 208 of the assembly 201.

The first end 203 of a assembly 201 in the first component 200 may be anchored at the first predetermined distance 205 from the primary shoulder 206 of a box end 406 of the first component 200 and the second end 208 of the a assembly 201 of a second component 407 may be anchored at the second predetermined distance 209 from the primary shoulder 206 of a pin end 408 of the second component 407 such that when joining the two components together results in mating the two assemblies 201. The assemblies 201 may be in compression at the connection due to the flare 305 at the end of each assembly 201. The mating surface of the assemblies 201 may be polished, flat, convex, concave, asymmetric, irregular, generally circular, generally rectangular, or combinations thereof. The first and second predetermined distances 205, 209 may be equal such that when the assemblies 201 are mated, there is no space between the stabilizing elements 400. This may help prevent buckling between the stabilizing element where the assemblies 201 are in compression. In other embodiments there may be several inches between the stabilizing elements when the assemblies 201 are mated. An electrically conductive mating surface 550 disposed within an electrically insulating material 551 may be inserted into the second end 208 of the assembly 201 after flaring the second end 208 of the assembly 201.

Figure 6:
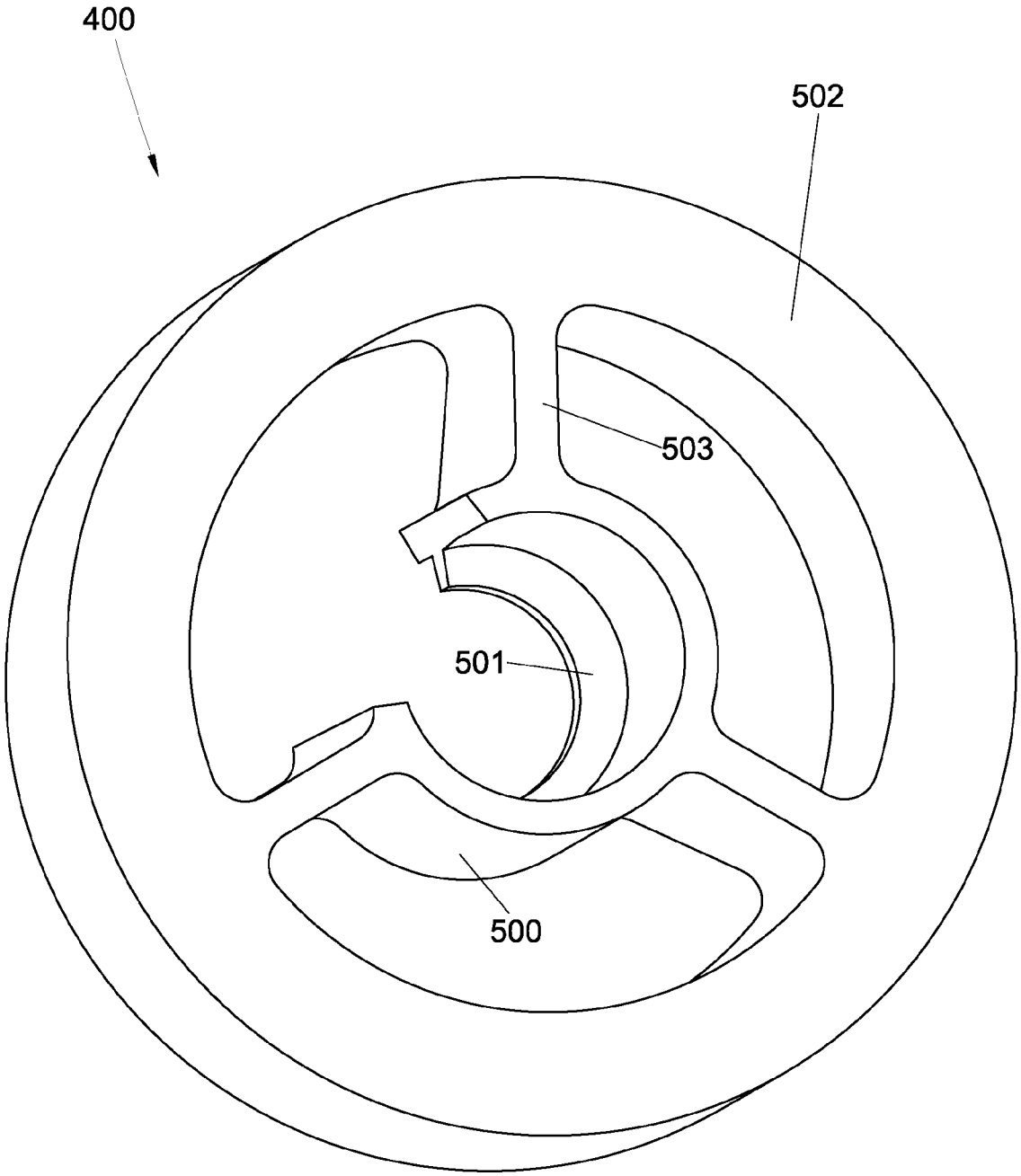
FIG. 6 is a perspective diagram of an embodiment of a stabilizing element.

The stabilizing element 400 may comprise a collar 500 designed to fasten to the assembly 201, as in the embodiment of FIG. 6. A shoulder 501 of the collar 500 may be configured to hold the flare of the assembly 201. An outer ring 502 may anchor the stabilizing element 400 inside of the tool string component. Fins 503 may connect the collar to the outer ring 502 while permitting the passage of fluid through the stabilizing element 400. In other embodiments, the stabilizing elements 400 may comprise wave springs, rods, bristles, beads, blocks, whiskers, plates, or combinations thereof. A portion of the collar 500 may be removed for ease of securing the assembly 201 in the stabilizing element 400.

Figure 7:
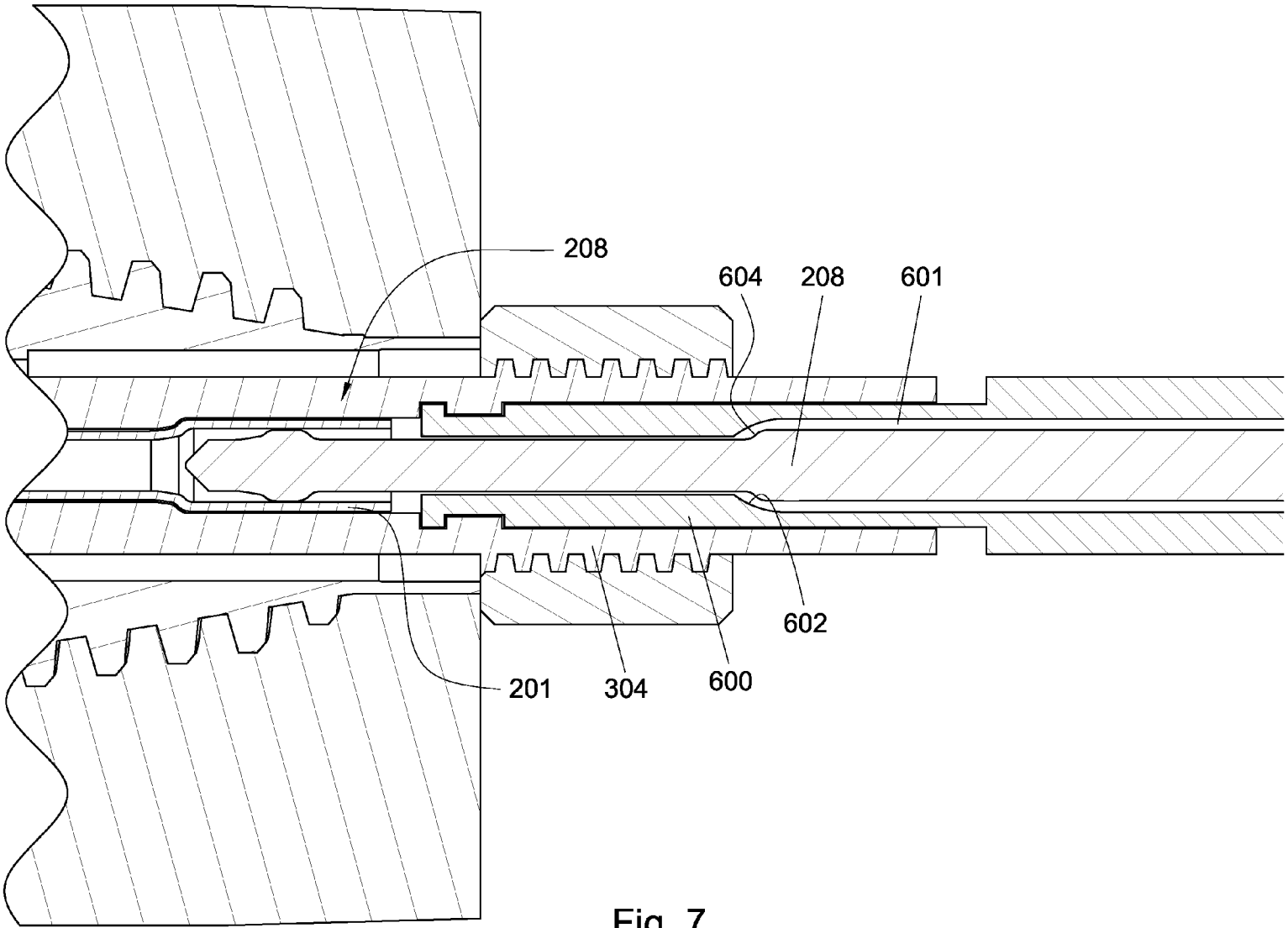
FIG. 7 is a cross-sectional diagram of another embodiment of a flaring apparatus.

The stretching tool 350 may be adapted to receive the flaring tool 303, as in the embodiment of FIG. 7. After the stretching tool 350 interlocks with the sleeve 304 and stretches the assembly 201, the flaring tool 303 may be inserted into a hollowed bore 601 of the stretching tool 350. An end of the flaring tool 303 may protrude from the stretching tool 350 such that the flaring tool 303 flares the second end 208 of the assembly 201. A shoulder 604 of the flaring tool 303 may abut a shoulder 602 of the stretching tool 350, preventing the flaring tool 303 from being inserted too far into the second end 208 of the assembly 201.

Figure 8:
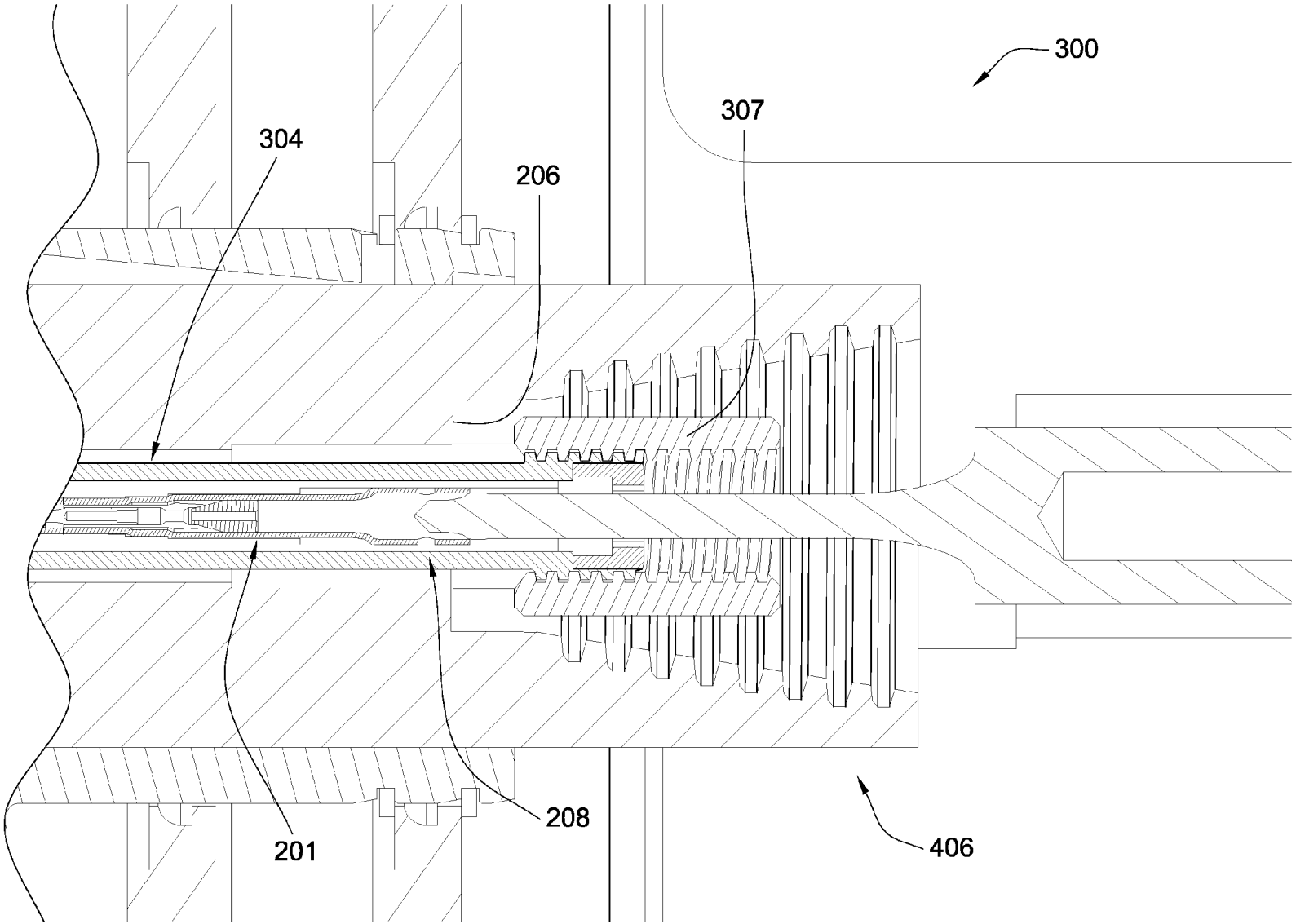
FIG. 8 is a cross-sectional diagram of another embodiment of a flaring apparatus.

The apparatus 300 may also be used to stretch and flare the second end 208 of the assembly 201 in a box end 406, as in the embodiment of FIG. 8. The second end 208 of the assembly 201 may extend beyond the primary shoulder 206 of the box end 406 after being stretched and while being flared. The threaded nut 307 may abut the primary shoulder 206 while threadedly connected to the sleeve 304 in order to temporarily anchor the assembly 201 while it is being flared.

Figure 9:
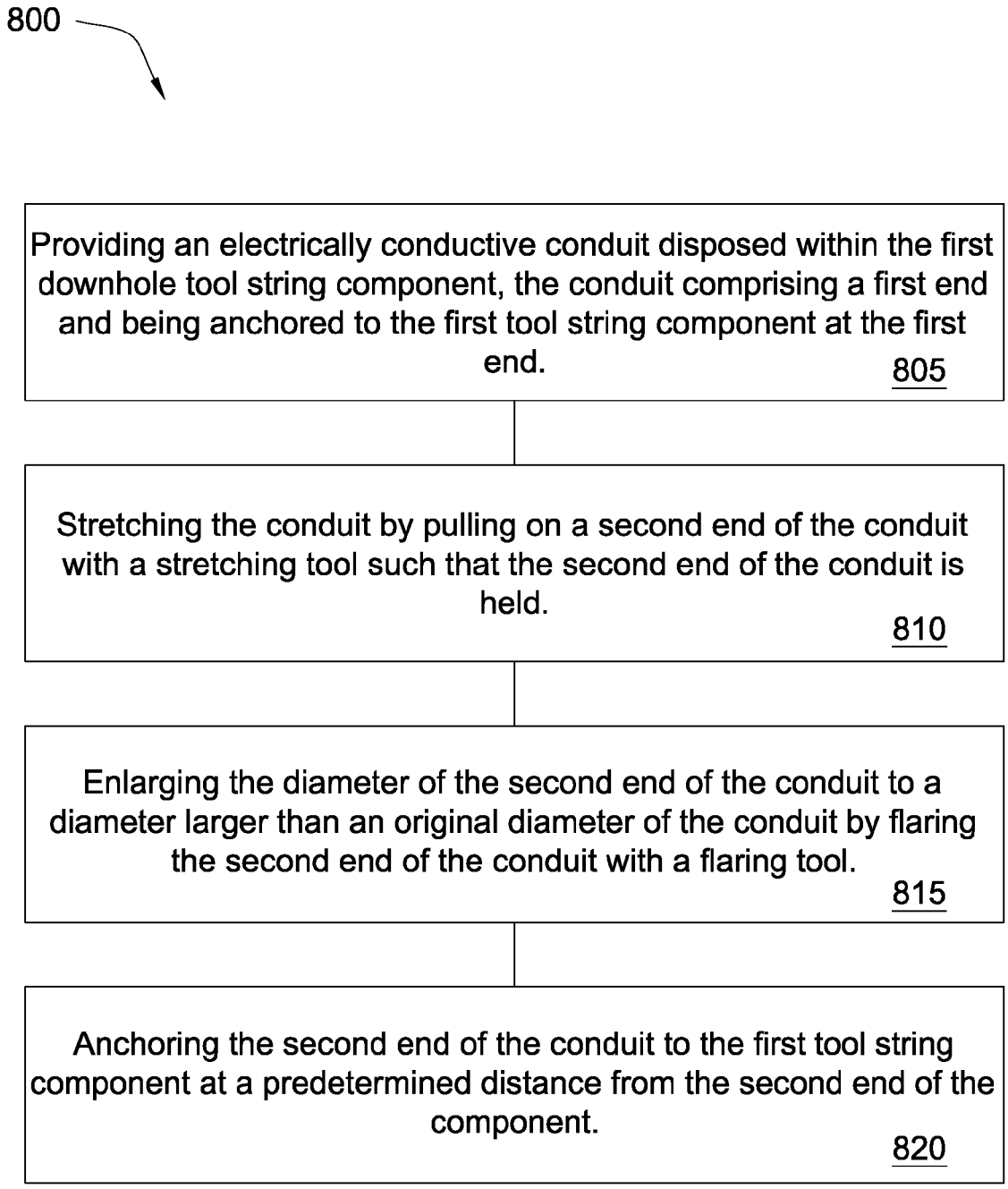
FIG. 9 discloses an embodiment of a method for making a downhole electrical transmission system.

FIG. 9 discloses a method 800 for making a downhole electrical transmission system, comprising providing 805 an electrically conductive assembly 201 disposed within a first downhole tool string component, the assembly 201 comprising a first end and being anchored to the first tool string component at a first predetermined distance from the first end of the component; stretching 810 the assembly 201 by pulling on a second end of the assembly 201 with a stretching tool such that the second end of the assembly 201 is held; enlarging 815 the diameter of the second end of the assembly 201 to a diameter larger than an original diameter of the assembly 201 by flaring the second end of the assembly 201 with a flaring tool; and anchoring 820 the second end of the assembly 201 to the first tool string component at a predetermined distance from the second end of the component.

Figure 10:
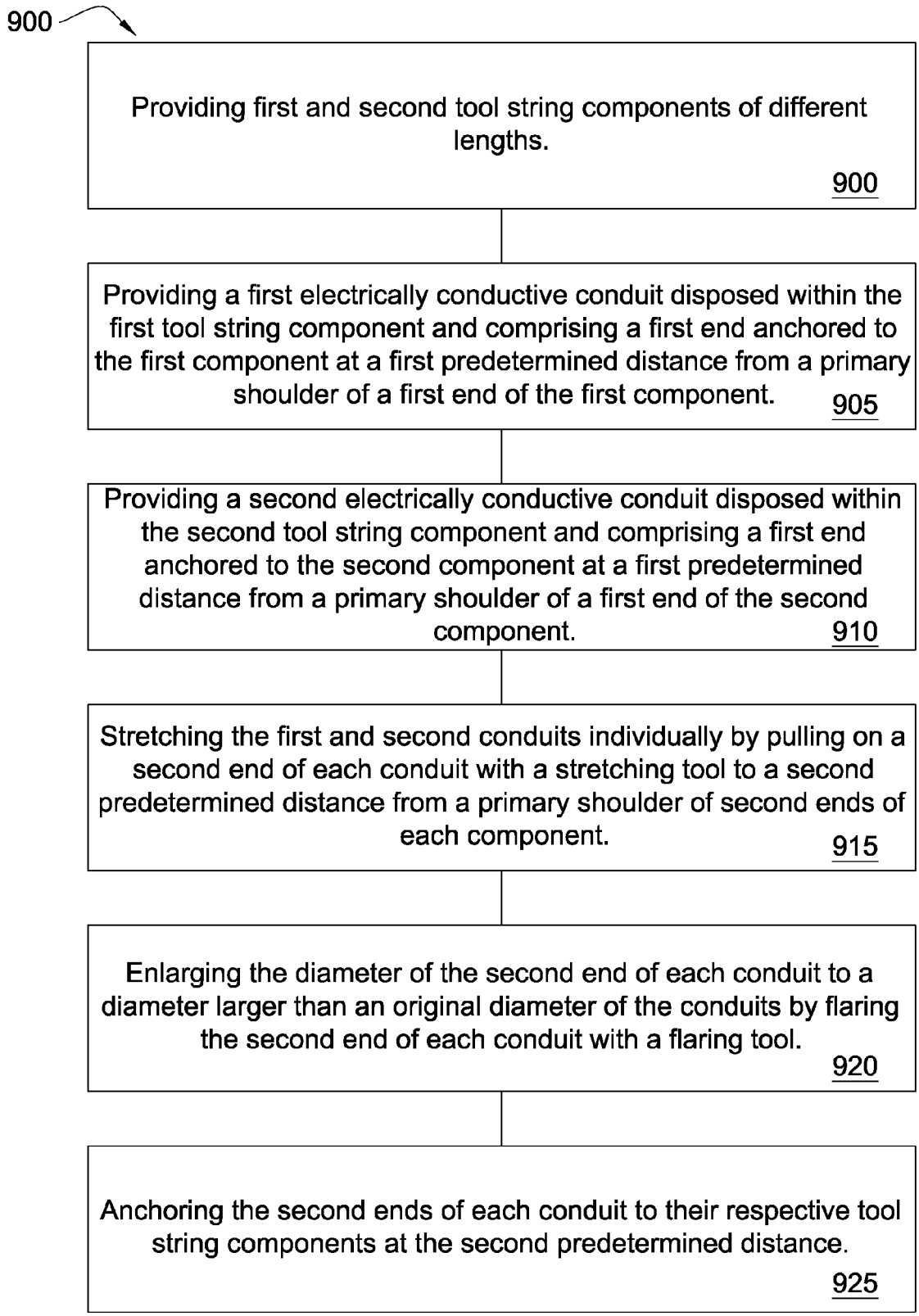
FIG. 10 discloses another embodiment of a method for making a downhole electrical transmission system.

FIG. 10 discloses another method 900 for making a downhole electrical transmission system, comprising providing 905 a first and second tool string components of different lengths; providing 910 a first electrically conductive assembly 201 disposed within the first tool string component and comprising a first end anchored to the first component at a first predetermined distance from a primary shoulder of a first end of the first component; providing 915 a second electrically conductive assembly 201 disposed within the second tool string component and comprising a first end anchored to the second component at the first predetermined distance from a primary shoulder of a first end of the second component; stretching 920 the first and second assemblies 201 individually by pulling on a second end of each assembly 201 with a stretching tool to a second predetermined distance from a primary shoulder of second ends of each component; enlarging 925 the diameter of the second end of each assembly 201 to a diameter larger than an original diameter of the assemblies 201 by flaring the second end of each assembly 201 with a flaring tool; and anchoring 930 the second ends of each assembly 201 to their respective tool string components at the second predetermined distance.

Whereas the present invention has been described in particular relation to the drawings attached hereto, it should be understood that other and further modifications apart from those shown or suggested herein, may be made within the scope and spirit of the present invention.

What is claimed is:

1. A method for making a downhole electrical transmission system, comprising:

providing an electrically conductive assembly disposed within a first downhole tool string component, the electrically conductive assembly comprising a first end and being anchored to the first tool string component at a first predetermined distance from a primary shoulder of the first end of the component;

stretching the electrically conductive assembly lengthwise by pulling on a second end of the assembly with a stretching tool such that the second end of the electrically conductive assembly is held;

enlarging the diameter of the second end of the electrically conductive assembly to a diameter larger than an original diameter of the electrically conductive assembly by flaring the second end of the electrically conductive assembly with a flaring tool; and anchoring the second end of the electrically conductive assembly to the first tool string component at a second predetermined distance from a primary shoulder of the second end of the component.

2. The method of claim 1, wherein the step of providing includes that the electrically conductive assembly is centered within the tool string component.

3. The method of claim 1, wherein the step of providing includes that a portion of the electrically conductive assembly is disposed along a bore wall of the first tool string component.

4. The method of claim 1, wherein the step of providing includes that the electrically conductive assembly comprises a plurality of flares at the first and second ends.

5. The method of claim 1, wherein the step of providing includes that an electrically conductive assembly disposed within a second tool string component is coupled with the electrically conductive assembly of the first tool string component.

6. The method of claim 1, wherein the step of providing includes that an electrically conductive assembly mating surface disposed within an electrically insulating material is inserted into the second end of the electrically conductive assembly after flaring the second end of the electrically conductive assembly.

7. The method of claim 1, wherein the step of stretching includes that the stretching tool is adapted to interlock with a sleeve disposed around the second end of the electrically conductive assembly.

8. The method of claim 1, wherein the step of providing includes that the electrically conductive assembly is anchored to a stabilizing element disposed within the first tool string component.

9. The method of claim 8, wherein the step of providing includes that the stabilizing element is brazed to a bore wall of the component.

10. The method of claim 8, wherein the step of providing includes that the stabilizing element is disposed within a recess in a bore wall of the component.

11. The method of claim 1, wherein the step of providing includes that a bracing assembly is disposed around at least a portion of the second end of the component.

12. The method of claim 11, wherein the step of providing includes that the bracing assembly is adapted to receive the stretching tool.

13. The method of claim 11, wherein the step of providing includes that the bracing assembly is adapted to receive the flaring tool.

14. The method of claim 11, wherein the step of providing includes that the bracing assembly comprises a pneumatic or hydraulic chamber.

15. The method of claim 11, wherein the step of providing includes that the bracing assembly is adapted to anchor the second end of the electrically conductive assembly after stretching the electrically conductive assembly.

16. The method of claim 1, wherein the step of stretching includes that the stretching tool comprises the flaring tool.

17. The method of claim 1, wherein the step of providing includes that the downhole tool string component is a drill pipe, a drill collar, a horizontal drill pipe, a reamer, a cross over sub, a heavy weight pipe, a production pipe, or combinations thereof.

18. A method for making a downhole electrical transmission system, comprising:

providing first and second tool string components of different lengths;

providing a first electrically conductive assembly disposed within the first tool string component and comprising a first end anchored to the first component at a first predetermined distance from a primary shoulder of a first end of the first component;

providing a second electrically conductive assembly disposed within the second tool string component and comprising a first end anchored to the second component at the first predetermined distance from a primary shoulder of a first end of the second component;

stretching the first and second electrically conductive assemblies lengthwise individually by pulling on a second end of each electrically conductive assembly with a stretching tool to a second predetermined distance from a primary shoulder of second ends of each component;

enlarging the diameter of the second end of each electrically conductive assembly to a diameter larger than an original diameter of the assemblies by flaring the second end of each electrically conductive assembly with a flaring tool; and anchoring the second ends of each electrically conductive assembly to their respective tool string components at the second predetermined distance.

* * * * *